US007658511B2

(12) United States Patent
Sugiyama et al.

(10) Patent No.: US 7,658,511 B2
(45) Date of Patent: Feb. 9, 2010

(54) ILLUMINATION DEVICE WITH REFLECTIVE HEAT RADIATING FINS

(75) Inventors: Yuji Sugiyama, Tokyo (JP); Hitoshi Shoda, Tokyo (JP); Takehiko Saigo, Tokyo (JP); Yoshifumi Kawaguchi, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 148 days.

(21) Appl. No.: 11/678,747

(22) Filed: Feb. 26, 2007

(65) Prior Publication Data

US 2007/0201233 A1 Aug. 30, 2007

(30) Foreign Application Priority Data

Feb. 28, 2006 (JP) ..... 2006-054150

(51) Int. Cl.
*F21V 29/00* (2006.01)

(52) U.S. Cl. ..... 362/294; 362/373; 362/310; 362/307; 362/311; 257/98; 165/133

(58) Field of Classification Search ..... 362/294, 362/373, 310, 307, 311; 257/98; 165/133
See application file for complete search history.

(56) References Cited

U.S. PATENT DOCUMENTS 831,311 A 9/1906 Strootman et al.
6,478,453 B2 * 11/2002 Lammers et al. ..... 362/294
6,966,677 B2 * 11/2005 Galli ..... 362/373
7,128,454 B2 * 10/2006 Kim et al. ..... 362/507
7,163,318 B2 * 1/2007 Panagotacos et al. ..... 362/294
2005/0174780 A1 * 8/2005 Park ..... 362/294
2006/0193139 A1 * 8/2006 Sun et al. ..... 362/373
2007/0097692 A1 * 5/2007 Suehiro et al. ..... 362/294

FOREIGN PATENT DOCUMENTS

| | | | |
|---|---|---|---|
| DE | 723479 | * | 8/1942 |
| JP | 2005093097 | | 4/2005 |
| WO | WO2004/100265 | | 11/2004 |
| WO | WO2006/013495 | | 2/2006 |

OTHER PUBLICATIONS

Search Report for European Patent App. No. 07003902 (Apr. 27, 2007).

* cited by examiner

*Primary Examiner*—Ismael Negron
(74) *Attorney, Agent, or Firm*—Cermak Kenealy Vaidya & Nakajima LLP

(57) ABSTRACT

An illumination device includes a light emitting element, and a plurality of radially disposed radiation fins for dissipating heat generated by the light emitting element. An aperture may be formed between adjacent ones of the radiation fins for allowing light from the light emitting element to pass therethrough. The radiation fins may further include a reflection surface for reflecting light which is blocked by the radiation fins when passing through the aperture.

13 Claims, 8 Drawing Sheets

ILLUMINATION DEVICE WITH REFLECTIVE HEAT RADIATING FINS

This application claims the priority benefit under 35 U.S.C. § 119 of Japanese Patent Application No. 2006-054150 filed on Feb. 28, 2006, which is hereby incorporated in its entirety by reference.

BACKGROUND

1. Field

The presently disclosed subject matter relates to an illumination device in which a plurality of radiation fins are disposed radially for dissipating heat generated by a light emitting element. In particular, the disclosed subject matter relates to an illumination device which is capable of radially radiating light generated from a light emitting element while the efficiency of dissipating heat from the light emitting element can be improved and in which the utilization efficiency of the light from the light emitting element can be improved.

2. Description of the Related Art

An illumination device has conventionally been known in which a plurality of fins for dissipating heat (radiation fins) are disposed radially for dissipating heat generated by a light emitting element (e.g., a light emitting element chip). An example of an illumination device of this type includes an illumination device described in Japanese Patent Laid-Open Publication No. 2005-93097.

The illumination device described in this publication is configured to include a plate-like base member, insulative heat sinks disposed on the plate-like base member, and light emitting element chips disposed on the respective insulative heat sinks. Furthermore, the illumination device is configured to include a cylindrical supporting body attached to the lower side (the rear face side) of the base member, and a plurality of rectangular plate-like fins for dissipating heat (radiation fins), attached to the outer peripheral surface of the cylindrical supporting body.

In this illumination device, the heat generated by the light emitting element chips is dissipated from the radiation fins through the insulative heat sinks, the base member, and the supporting body.

In the illumination device, the insulative heat sinks are disposed rearward in the central axis direction of the illumination device with respect to the light emitting element chips. The base member is disposed rearward with respect to the insulative heat sinks in the central axis direction. In addition, the supporting body and the radiation fins are disposed rearward with respect to the base member in the central axis direction.

Therefore, the radiation fins are disposed at positions relatively distanced from the light emitting element chips in the central axis direction of the illumination device. Hence, the heat conduction path from the light emitting element chips to the radiation fins is long. Therefore, the heat dissipation efficiency of the radiation fins is low.

Meanwhile, in order to reduce the length of the heat conduction path from the light emitting element chips to the radiation fins, it is conceivable that the supporting body and the radiation fins are disposed radially outside of the light emitting portion having the light emitting element chips. In other words, the supporting body and the radiation fins can be disposed at positions which are not rearward with respect to the light emitting element chips in the central axis direction of the illumination device. However, in such a case, the light radially emitted from the light emitting element chips may be blocked by both the supporting body and the radiation fins which are both radially arranged. Therefore, the light from the light emitting element chips cannot be efficiently radiated in the radial direction of the illumination device.

SUMMARY

In view of the foregoing and other issues and characteristics of lighting devices, an aspect of the presently disclosed subject matter is to provide an illumination device which is capable of radially radiating light generated from a light emitting element while maintaining relatively high efficiency of dissipating heat generated by the light emitting element.

In accordance with another aspect of the disclosed subject matter, an illumination device can be provided in which the utilization efficiency of light from a light emitting element can be improved as compared to the case in which the light emitted from a light emitting element is absorbed by the surface of radiation fins.

According to yet another of the aspects of the disclosed subject matter is an illumination device that can include a light emitting element, and a plurality of radiation fins for dissipating heat generated by the light emitting element, wherein the radiation fins are radially disposed. In this illumination device, an aperture for allowing light from the light emitting element to pass therethrough can be formed between adjacent ones of the radiation fins and a reflection surface for reflecting light which is blocked by the radiation fins when passing through the aperture is formed on a surface of each of the radiation fins, but not necessarily all of the fins.

In this illumination device, the plurality of radiation fins may be disposed radially outside of the light emitting element. The radiation fins can also be disposed in relatively close proximity to the light emitting element such that the light from the light emitting element passes between adjacent ones of the radiation fins. The plurality of the radiation fins can also be disposed radially outside of the light emitting element. Therefore, the efficiency of dissipating heat generated by the light emitting element can be improved as compared to the case in which each of the radiation fins is disposed at a position further away from the light emitting element.

In another aspect of an illumination device, the light emitted from the light emitting element is allowed to pass through apertures between the plurality of radially disposed radiation fins and can then be radiated radially.

In addition, in an illumination device according to an aspect of the disclosed subject matter, part of the light emitted from the light emitting element and which is allowed to pass through the apertures between adjacent ones of the radiation fins impinges on the surface of the radiation fins. Then, the part of the light is reflected by the surface of the radiation fins, and thus is efficiently utilized. Therefore, the utilization efficiency of the light from the light emitting element can be improved as compared to a case in which light emitted from the light emitting element impinges on the surface of the radiation fins and is absorbed by the surface of the radiation fins.

That is, according to an aspect of the disclosed subject matter, the efficiency of dissipating the heat generated by the light emitting element can be improved, and at the same time, the light from the light emitting element can be radiated radially. In addition, the utilization efficiency of the light from the light emitting element can be improved as compared to the case in which light emitted from the light emitting element is absorbed by the surface of the radiation fins.

In accordance with another aspect of the disclosed subject matter, the illumination device can further include an annular bridging structure that is configured to bridge the plurality of radiation fins. A reflection surface for reflecting light which is blocked by the bridging structure when passing through the aperture can be formed on a part of a surface of the bridging structure that faces the plurality of radiation fins.

The bridging structure can be configured as means for bridging the plurality of the radiation fins. Part of the light emitted from the light emitting element and which is allowed to pass through the apertures between adjacent ones of the radiation fins impinges on the surface of the means for bridging. Then, light is reflected by the surface of the means for bridging and thus is efficiently utilized.

Accordingly, the utilization efficiency of the light from the light emitting element can be improved as compared to a case in which the light emitted from the light emitting element and which impinges on a surface of the means for bridging is absorbed by the surface of the means for bridging.

In another aspect of the disclosed subject matter, the illumination device may be configured such that a pair of bridging structures is disposed at central axial ends of the plurality of the radially disposed radiation fins. In such an illumination device, separate bridging structures for the plurality of radiation fins can be disposed at each of the axial ends of the plurality of radially disposed radiation fins. Therefore, the stiffness of the plurality of radially disposed radiation fins can be improved as compared to the case in which a single bridging structure is disposed at only one of the axial ends of the radiation fins.

In accordance with another aspect of an illumination device according to the disclosed subject matter, the lens for guiding the light from the light emitting element may be press-fitted inside the inner peripheral surface of one of the annular bridging structures. In other words, the bridging structure can function to bridge the plurality of radiation fins while also functioning to position and secure the lens. Therefore, a separate component for positioning and securing the lens is not required to be provided apart from the bridging structure.

In accordance with another aspect of the disclosed subject matter, the bridging structure and the plurality of radiation fins may be formed as a single component. It is also possible to prevent the deviation of the light path from the desired light path from the light emitting elements.

BRIEF DESCRIPTION OF THE DRAWINGS

These and other characteristics, features, and advantages of the disclosed subject matter will become clear from the following description with reference to the accompanying drawings, wherein.

DETAILED DESCRIPTION OF EXEMPLARY EMBODIMENTS

Figure 1A:
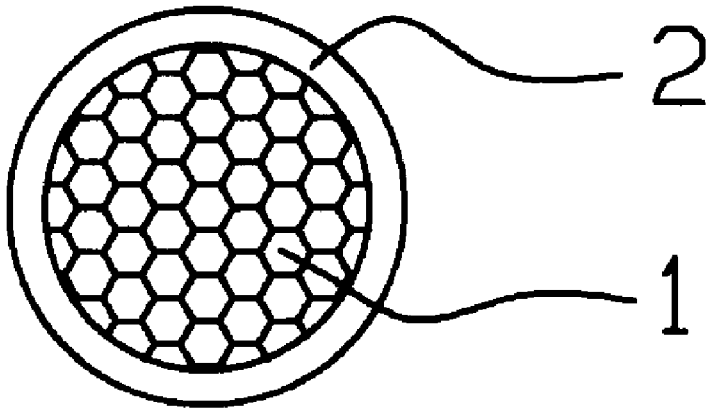
FIG. 1A is a plan view of an illumination device according to one exemplary embodiment of the presently disclosed subject matter.
Figure 1B:
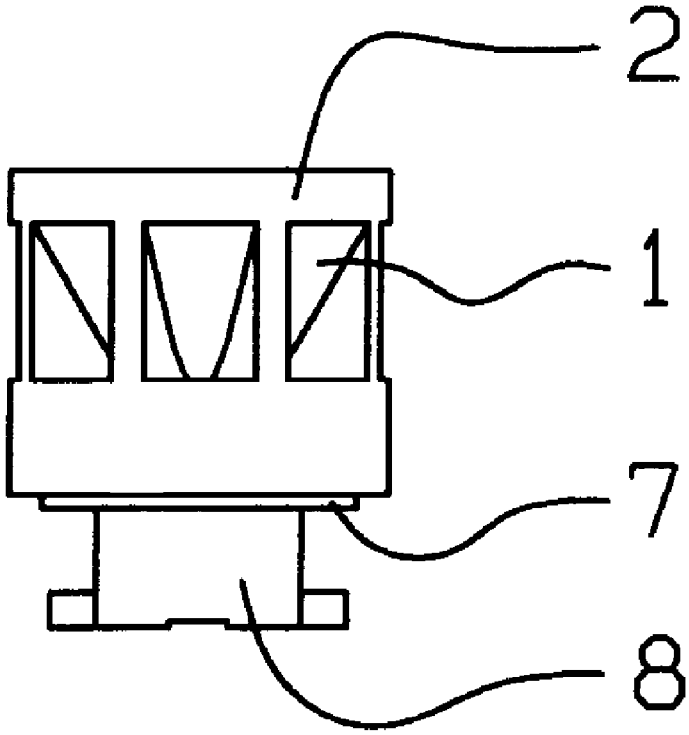
FIG. 1B is a front view of the illumination device of FIG. 1A.
Figure 2:
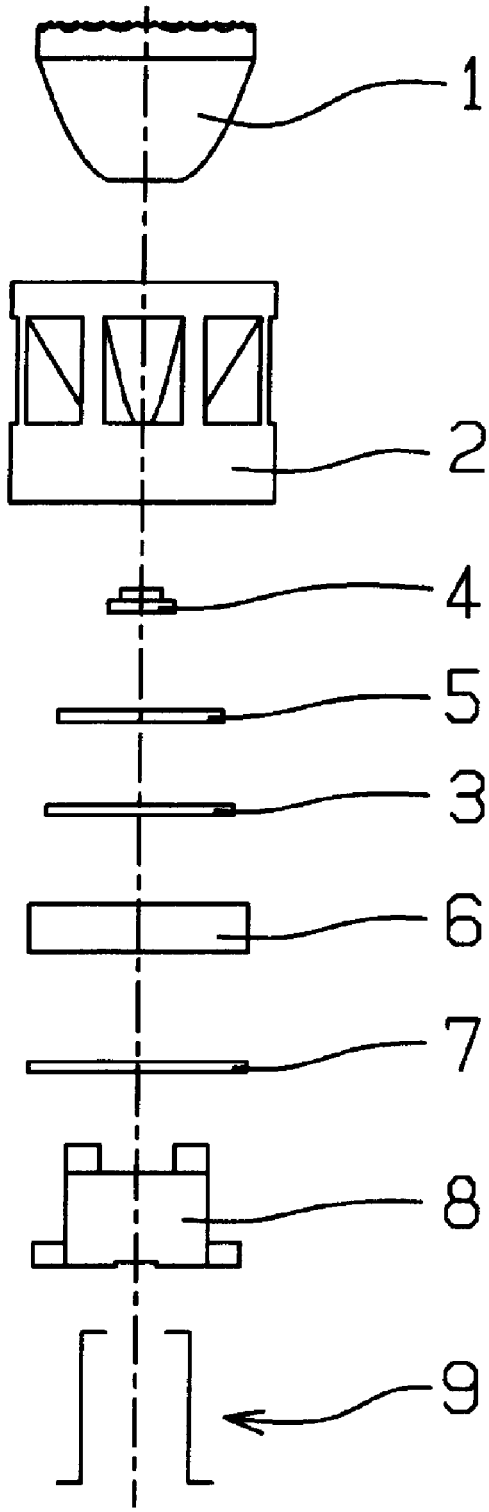
FIG. 2 is an exploded view of the illumination device of the exemplary embodiment shown in FIGS. 1A and 1B.

Hereinafter, a description will be given of exemplary embodiments of the illumination device made in accordance with principles of the disclosed subject matter. FIG. 1A is a plan view of an exemplary illumination device made in accordance with principles of the disclosed subject matter, and FIG. 1B is a front view of the same illumination device. FIG. 2 is an exploded view of the illumination device shown in FIGS. 1A and 1B.

In FIGS. 1A, 1B, and 2, the reference numeral 1 refers to a lens, and the reference numeral 2 refers to a lens holder for holding the lens 1. The reference numeral 3 refers to a heat conducting sheet having a generally O-shape, and the reference numeral 4 refers to a light emitting element, such as an LED, etc. The reference numeral 5 refers to a substrate for supporting the light emitting element 4, and the reference numeral 6 refers to a supporting member for supporting the substrate 5. The reference numeral 7 refers to a heat conducting sheet having a generally O-shape, and the reference numeral 8 refers to a socket. The reference numeral 9 refers to a lead wire for electrically connecting a contact (not shown) formed in the socket 8 and the substrate 5.

In use, the illumination device of the exemplary embodiment shown in FIGS. 1A, 1B, and 2 can be mounted on a mounting member (not shown) having, for example, a key hole-shaped hole (not shown). Specifically, the right and left end portions of the socket 8 are allowed to pass through the key hole-shaped hole and are inserted to the lower side of the mounting member. Subsequently, the illumination device can be entirely rotated by, for example, 90° about the central axis thereof (the alternate long and short dashed line in FIG. 2). Hence, the illumination device can be secured to the mounting member such that the right and left end portions of the socket 8 are prevented from being disconnected from the key hole-shaped hole. The disconnection from the mounting member can be carried out through the reverse operation.

When the illumination device is secured to the mounting member (not shown), the contact (not shown) formed in the socket 8 is brought into contact with a printed circuit board (not shown) disposed on the lower side of the mounting member. Hence, the light emitting element 4 of the illumination device is ready to be turned on.

When the light emitting element 4 is turned on, part of the light emitted from the light emitting element 4 enters the lens 1 through the lower surface of the lens 1 (the lower surface in FIG. 2). Then, the light is diffused through a lens-cut portion of the upper surface of the lens 1 (the upper surface in FIG. 2) and is radiated upward (toward the upper side in FIGS. 1B and 2). Furthermore, part of the light that has entered the lens 1 is emitted from the side surface of the lens 1. The light is then radiated generally radially through the side surface of the lens holder 2.

Furthermore, when the light emitting element 4 is turned on, part of the heat generated by the light emitting element 4 is conducted to the mounting member (not shown) through the substrate 5, the heat conducting sheet 3, the supporting member 6, and the heat conducting sheet 7 and is dissipated from the surface of the mounting member. At the same time, part of the heat generated by the light emitting element 4 is conducted to the lens holder 2 through the substrate 5, the heat conducting sheet 3, and the supporting member 6, and is dissipated from the surface of the lens holder 2.

Figure 3A:
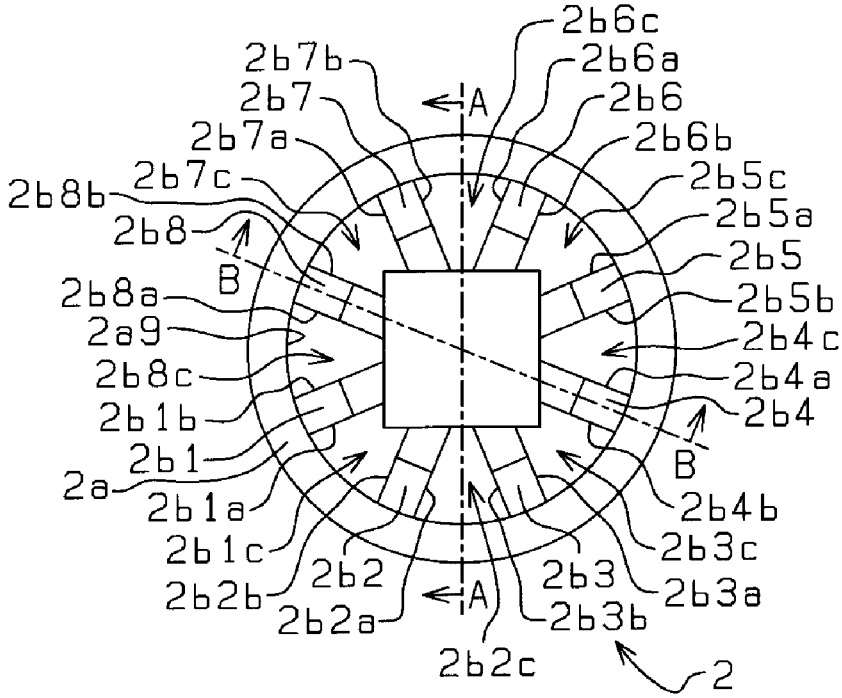
FIG. 3A is a plan view of a lens holder 2 shown in FIGS. 1A, 1B, and 2.
Figure 7A:
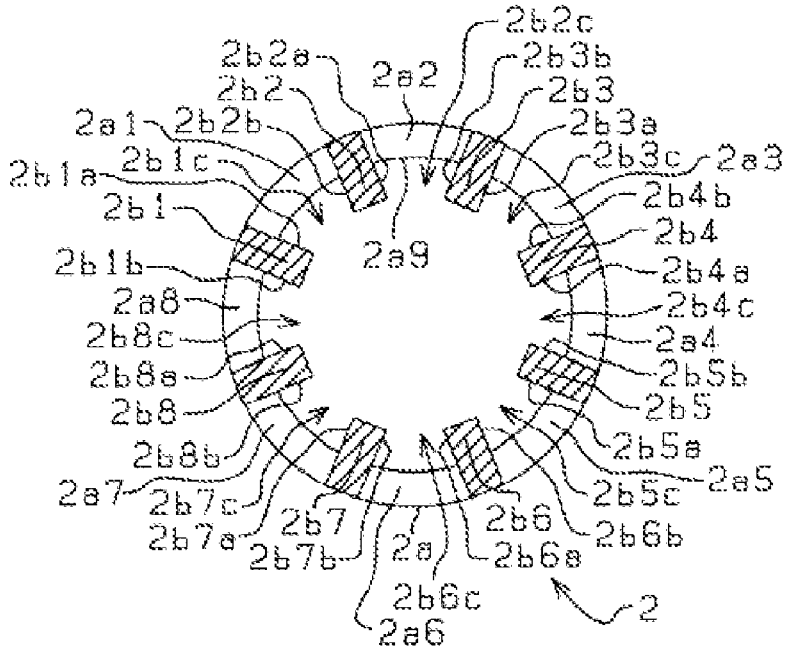
FIG. 7A is a sectional view of the lens holder 2 taken along line C-C in FIG. 3B.
Figure 7B:
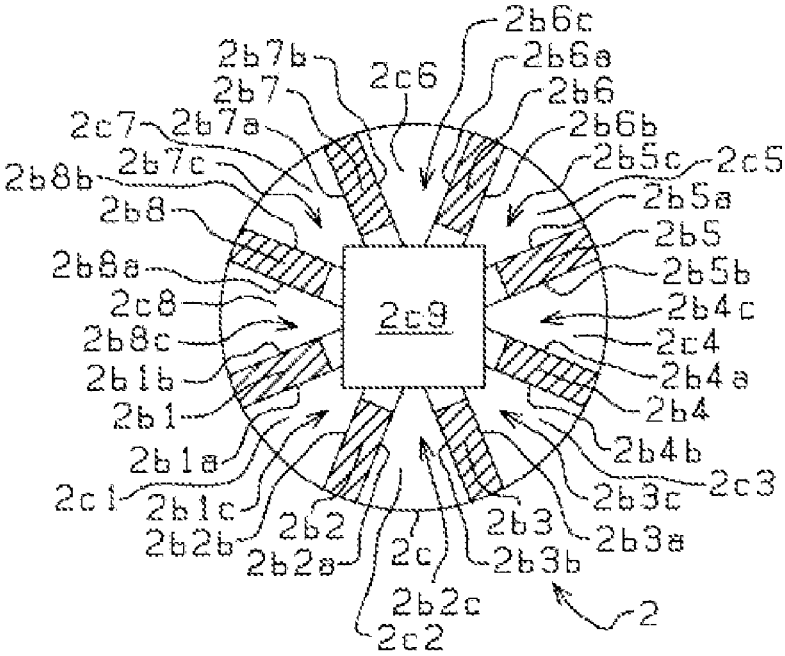
FIG. 7B is a sectional view of the lens holder 2 taken along line D-D in FIG. 3B.

FIGS. 3A to 7B show enlarged views of the lens holder 2 shown in FIGS. 1A, 1B, and 2. Specifically, FIG. 3A is a plan view of the lens holder 2, and FIG. 3B is a front view of the lens holder 2. FIG. 4A is a left side view of the lens holder 2, and FIG. 4B is a right side view of the lens holder 2. FIG. 5A is a rear side view of the lens holder 2, and FIG. 5B is a bottom view of the lens holder 2. FIG. 6A is a cross sectional view taken along line A-A in FIG. 3A, and FIG. 6B is a cross sectional view taken along line B-B in FIG. 3A. Furthermore, FIG. 7A is a cross sectional view taken along line C-C in FIG. 3B, and FIG. 7B is a cross sectional view taken along line D-D in FIG. 3B.

In FIGS. 3 to 7, each of the reference numerals 2*b*1, 2*b*2, 2*b*3, 2*b*4, 2*b*5, 2*b*6, 2*b*7, and 2*b*8 refers to a radiation fin formed in the lens holder 2 that is configured to dissipate the heat generated by the light emitting element 4. Each of the reference numerals 2*a* and 2*c* refers to an annular bridging portion that is configured to bridge the eight radiation fins 2*b*1-*b*8. The reference numeral 2*a*9 refers to the inner peripheral surface of the bridging portion 2*a*. The reference numeral 2*c*9 represents an aperture formed in the bridging portion 2*c* in order to accommodate the light emitting element 4 (see, for example, FIGS. 5B, 6A, and 6B.

As shown in FIGS. 3A, 7A, and 7B, in the illumination device of the exemplary embodiment, the eight radiation fins 2*b*1-2*b*8 are disposed radially. In detail, part of the heat generated by the light emitting element 4 is dissipated from the surface of the radiation fins 2*b*1-2*b*8 of the lens holder 2. Furthermore, as shown in FIGS. 3B, 4A, 4B, 5A, 6A, and 6B, the bridging portions 2*a* and 2*c* are disposed at the respective ends of the radiation fins 2*b*1-2*b*8 which are opposed to each other in the direction of a central axis L of the lens holder 2. As shown in detail, the bridging portions 2*a* and 2*c* and the radiation fins 2*b*1-2*b*8 can be formed as a single component.

Furthermore, the lens 1 can be press-fitted inside the inner peripheral surface 2*a*9 of the bridging portion 2*a* of the lens holder 2. Thus, the lens 1 is held by the lens holder 2. Therefore, in the illumination device of the exemplary embodiment, the lens holder 2 functions to dissipate the heat generated by the light emitting element 4 while functioning to hold the lens 1.

Moreover, in the illumination device of the exemplary embodiment, as shown in FIGS. 3A, 3B, 4A, 6A, 7A, and 7B, an aperture 2*b*1*c* can be provided that allows light to pass therethrough from the light emitting element 4 disposed on the central axis line L of the lens holder 2 (see FIG. 2). The aperture 2*b*1*c* can be formed between the radiation fins 2*b*1 and 2*b*2 that are located adjacent to each other. In the same manner, each of apertures 2*b*2*c*, 2*b*3*c*, 2*b*4*c*, 2*b*5*c*, 2*b*6*c*, 2*b*7*c*, and 2*b*8*c* can be formed between respective adjacent fins.

Therefore, in the illumination device of the exemplary embodiment, part of the light emitted from the light emitting element 4 enters the lens 1 through the lower surface of the lens 1 (the lower surface in FIG. 2). The light is then allowed to be emitted from the side surface of the lens 1 to be radiated generally radially through the apertures 2*b*1*c* to 2*b*8*c* of the lens holder 2.

Furthermore, as shown in FIGS. 3A, 3B, 6A, 7A, and 7B, a reflection surface 2*b*1*a* can be formed on the radiation fin 2*b*1 soas to reflect light which is part of the light emitted from the light emitting element 4 (see FIG. 2). The light can then be allowed to pass through the aperture 2*b*1*c* and impinge on the radiation fin 2*b*1. Also, in the same manner as described above, reflection surfaces 2*b*1*b*, 2*b*2*a*, 2*b*2*b*, 2*b*3*a*, 2*b*3*b*, 2*b*4*a*, 2*b*4*b*, 2*b*5*a*, 2*b*5*b*, 2*b*6*a*, 2*b*6*b*, 2*b*7*a*, 2*b*7*c*, 2*b*8*a*, and 2*b*8*b* can be formed on corresponding respective radiation fins.

Figure 3B:
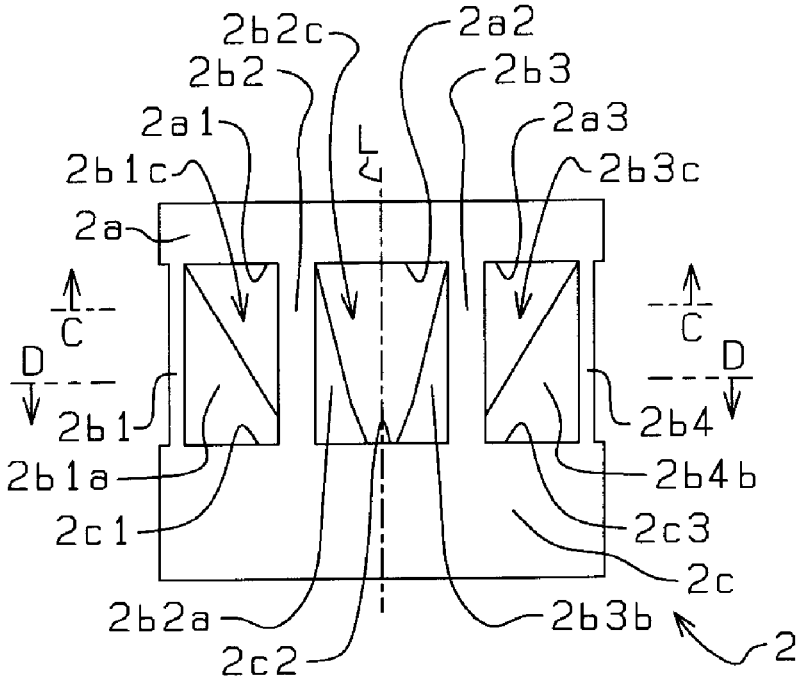
FIG. 3B is a front view of the same lens holder 2.
Figure 4A:
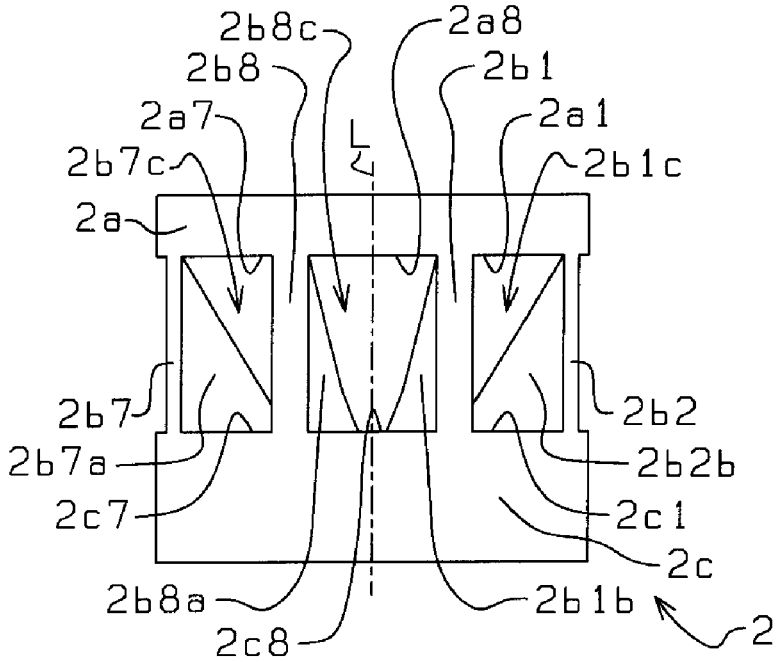
FIG. 4A is a left side view of the lens holder 2 shown in FIGS. 1A, 1B, and 2.
Figure 4B:
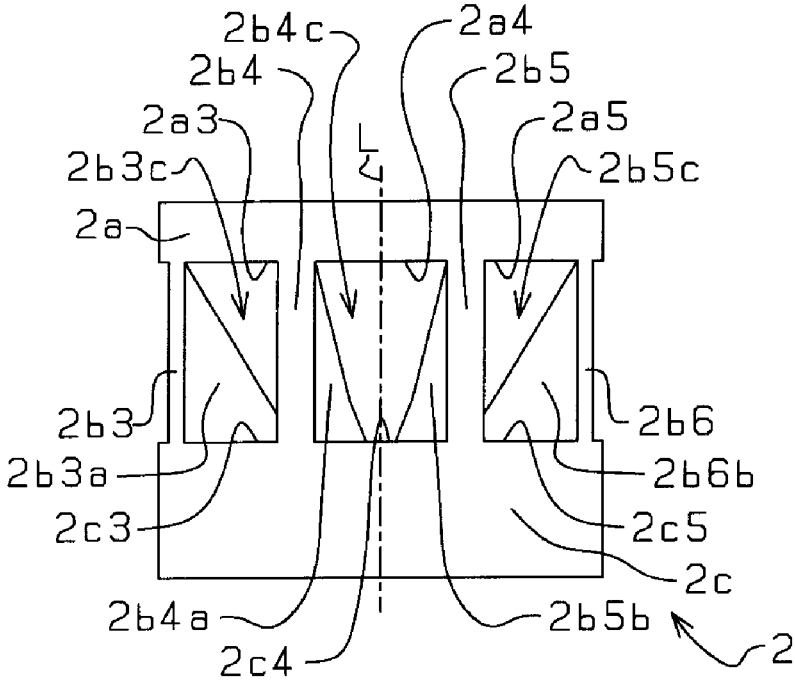
FIG. 4B is a right side view of the same lens holder 2.
Figure 5A:
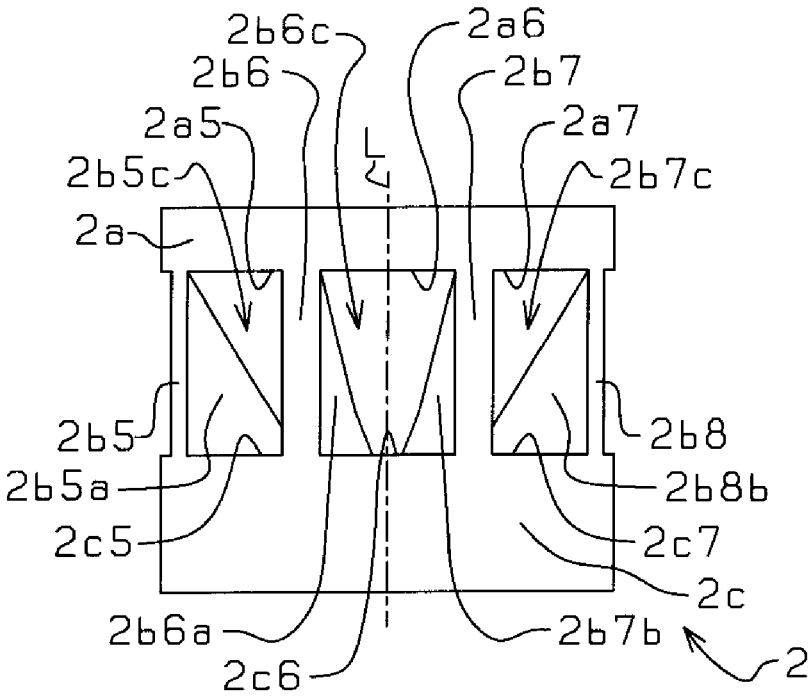
FIG. 5A is a rear side view of the lens holder 2 shown in FIGS. 1A, 1B, and 2.
Figure 5B:
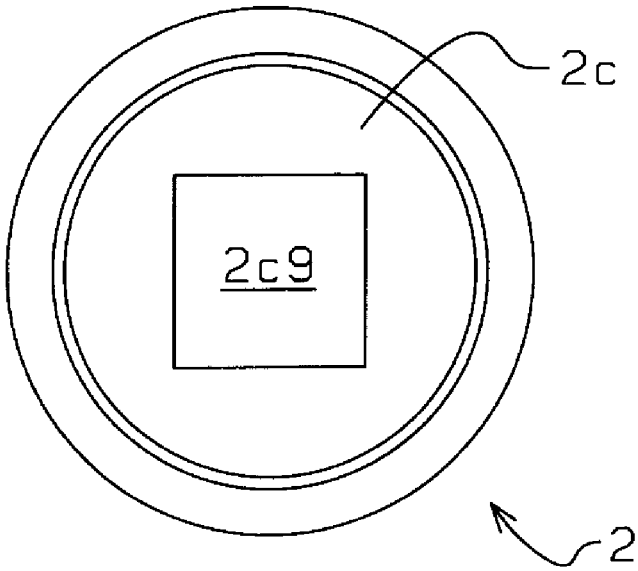
FIG. 5B is a bottom view of the same lens holder 2.
Figure 6A:
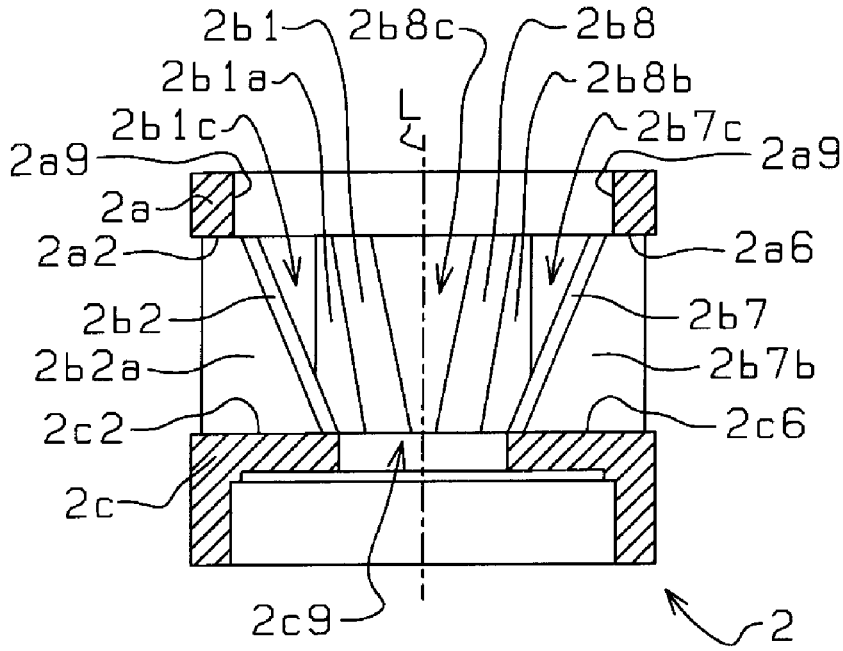
FIG. 6A is a sectional view of the lens holder 2 taken along line A-A in FIG. 3A.
Figure 6B:
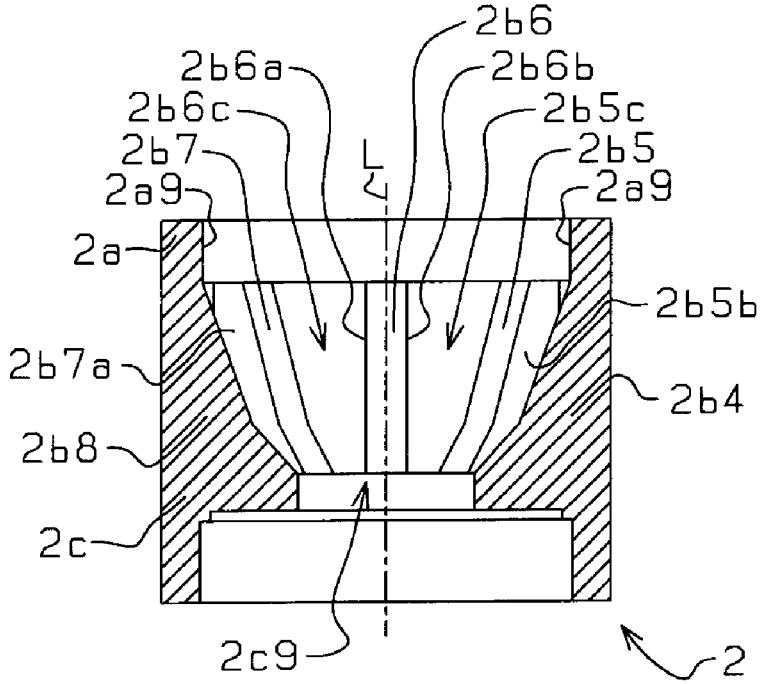
FIG. 6B is a sectional view of the lens holder 2 taken along line B-B in FIG. 3A.

Furthermore, as shown in FIGS. 3B, 4A, and 7A, a reflection surface 2*a*1 can be formed on a surface on the lower side (the lower side in FIGS. 3B and 4A, or the side facing the radiation fins 2*b*1 and 2*b*2) of the bridging portion 2*a*. This reflection surface 2*a*1 is provided for reflecting the light which is part of the light emitted from the light emitting element 4 (see FIG. 2) and which is allowed to pass through the aperture 2*b*1*c* and which impinges on the bridging portion 2*a*. Also, in the same manner as described above, reflection surfaces 2*a*2, 2*a*3, 2*a*4, 2*a*5, 2*a*6, 2*a*7 and 2*a*8 can be formed on the surface on the lower side of the bridging portion 2*a* corresponding to the respective apertures. Furthermore, as shown in FIGS. 3B, 4A, and 7A, a reflection surface 2*c*1 can be formed on a surface on the upper side (the upper side in FIGS. 3B and 4A, or the side facing the radiation fins 2*b*1 and 2*b*2) of the bridging portion 2*c*. This reflection surface 2*c*1 can be provided for reflecting the light which is part of the light emitted from the light emitting element 4 (see FIG. 2) and which is allowed to pass through the aperture 2*b*1*c* and which impinges on the bridging portion 2*c*. Also, in the same manner as described above, reflection surfaces 2*c*2, 2*c*3, 2*c*4, 2*c*5, 2*c*6, 2*c*7 and 2*c*8 can be formed on a surface on the upper side of the bridging portion 2*c* corresponding to the respective apertures.

Figure 8A:
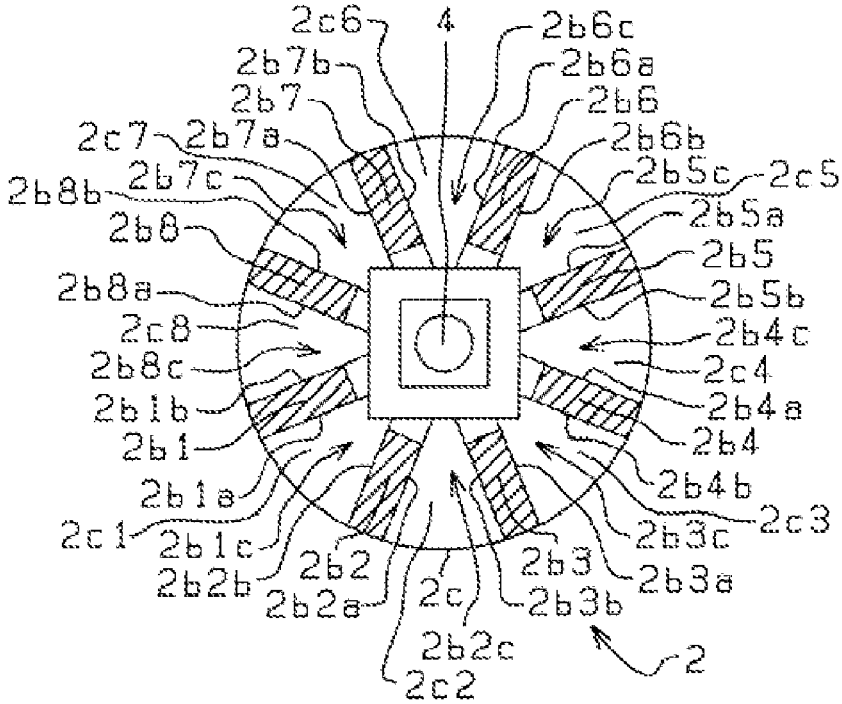
FIGS. 8A and 8B are views illustrating the positional relationship between the lens holder 2 and the light emitting element 4 of the illumination device of the exemplary embodiment of FIGS. 1A and 1B.
Figure 8B:
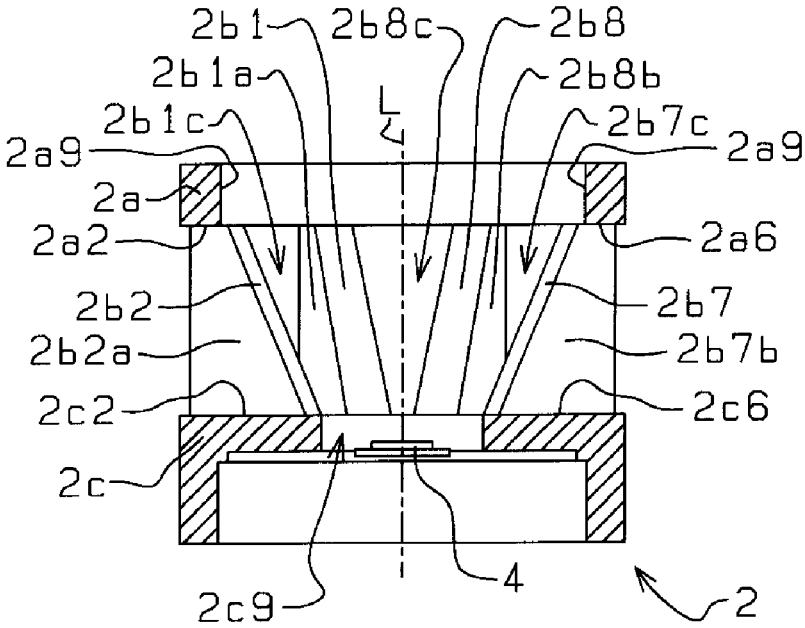

FIGS. 8A and 8B are views illustrating the positional relationship between the lens holder 2 and the light emitting element 4 in the illumination device of the exemplary embodiment. Specifically, FIG. 8A is a view which corresponds to the cross sectional view of the lens holder 2 shown in FIG. 7B and to which the light emitting element 4 is added. Furthermore, FIG. 8B is a view which corresponds to the cross sectional view of the lens holder 2 shown in FIG. 6A and to which the light emitting element 4 is added.

As shown in FIG. 8A, the radiation fins 2*b*1-2*b*8 can be disposed radially outside of and extend from the light emitting element 4. Each of the apertures 2*b*1*c*-2*b*8*c* that are configured for allowing the light from the light emitting element 4 to pass therethrough is formed between corresponding adjacent ones of the radiation fins 2*b*1-2*b*8.

In detail, as shown in FIG. 8B, the radiation fins 2*b*1-2*b*8 can be disposed in relatively close proximity to the light emitting element 4 such that the light from the light emitting element 4 is allowed to pass through the space between adjacent ones of the radiation fins 2*b*1-2*b*8. Specifically, the amount of the displacement between the light emitting element 4 and each of the radiation fins 2*b*1-2*b*8 in the vertical direction in FIG. 8B is set to a relatively small value.

Therefore, the efficiency of dissipating the heat generated by the light emitting element 4 can be improved as compared to the case in which each of the radiation fins 2*b*1-2*b*8 is disposed at a position relatively distanced from the light emitting element 4 (for example, distanced in the radial direction in FIG. 8A and the vertical direction in FIG. 8B).

Further, as shown in FIG. 8(A), each of the apertures 2*b*1*c*-2*b*8*c* for allowing the light from the light emitting element 4 to pass therethrough can be formed between corresponding adjacent ones of the radiation fins 2*b*1-2*b*8. Accordingly, the light emitted from the light emitting element 4 is allowed to pass through the apertures 2*b*1*c*-2*b*8*c* and is then radiated radially. Therefore, the light from the light emitting element 4 can be radiated not only upward in FIG. 1B but also radially.

Moreover, as shown in FIG. 8A, each of the reflection surfaces 2*b*1*a*, 2*b*1*b*-2*b*8*a*, 2*b*8*b*, for reflecting the light which is blocked by a fin when passing through the apertures 2*b*1*c*-2*b*8*c*, is formed on the surface of a corresponding one of the radiation fins 2*b*1-2*b*8.

In other words, in the illumination device of the exemplary embodiment, part of the light emitted from the light emitting element 4 that is allowed to pass through one of the apertures 2*b*1*c*-2*b*8*c* located between corresponding adjacent ones of the radiation fins 2*b*1-2*b*8 impinges on the surface of the corresponding one of the radiation fins 2*b*1-2*b*8. Then, that part of the light is reflected from the surface of the corresponding one of the radiation fins 2*b*1-2*b*8 and is thus efficiently utilized.

Therefore, the utilization efficiency of the light from the light emitting element 4 can be improved as compared to a case in which the light emitted from the light emitting element 4 which impinges on the surface of the radiation fins is absorbed by the surface of the radiation fins.

Furthermore, as shown in FIGS. 3B, 4A, 4B, and 5A, annular bridging portions 2*a* and 2*c* can be provided for bridging the eight radiation fins 2*b*1-2*b*8. In addition to this, reflection surfaces 2*a*1-2*a*8, and 2*c*1-2*c*8 can be provided for reflecting part of the light which is blocked by the bridging portions 2*a* and 2*c* when passing through the apertures 2*b*1*c*-2*b*8*c* located between the corresponding adjacent ones of the radiation fins 2*b*1-2*b*8. Each of the reflection surfaces 2*a*1-2*a*8, and 2*c*1-2*c*8 can be formed on a part of the surface which corresponds to one of the apertures 2*b*1*c*-2*b*8*c*.

In other words, part of the light emitted from the light emitting element 4 and being allowed to pass through the apertures 2*b*1*c*-2*b*8*c* impinges on the surface of the bridging portions 2*a* and 2*c*. Then, that light is reflected by the reflection surfaces 2*a*1-2*a*8 of the bridging portion 2*a*, and the reflection surfaces 2*c*1-2*c*8 of the bridging portion 2*c*, and thus is efficiently utilized.

Therefore, according to the illumination device of the exemplary embodiment, the utilization efficiency of the light from the light emitting element 4 can be improved as compared to a case in which the light emitted from the light emitting element 4 and which impinges on the surface of the bridging portions 2*a* and 2*c* is absorbed by the surfaces of the bridging portions 2*a* and 2*c*.

Furthermore, the annular bridging portions 2*a* and 2*c* can be disposed at the respective axial ends of the eight radiation fins 2*b*1-2*b*8. Therefore, according to the illumination device of the exemplary embodiment, the stiffness of the eight radiation fins 2*b*1-2*b*8 can be improved as compared to the case in which a bridging portion is disposed only at one axial end of the eight radiation fins.

Moreover, the lens 1 for guiding the light from the light emitting element 4 can be press-fitted inside the inner peripheral surface 2*a*9 of the annular bridging portion 2*a*. In other words, the bridging portion 2*a* can function to bridge the eight radiation fins 2*b*1-2*b*8 while also positioning and securing the lens 1. Therefore, according to the illumination device of the exemplary embodiment, a separate component for positioning and securing the lens 1 is not required apart from the bridging portion 2*a*.

Furthermore, the bridging portion 2*a*, the bridging portion 2*c*, and the eight radiation fins 2*b*1-2*b*8 can be formed as a single integral component. When the bridging portion 2*a*, the bridging portion 2*c*, and the eight radiation fins 2*b*1-2*b*8 are not integrated, but formed from separate components, the light path of the light emitted from the light emitting element 4 and then radiated through both the lens 1 that is secured to the bridging portion 2*a* and through the reflection surfaces formed on the bridging portions 2*a* and 2*c* and the radiation fins 2*b*1-2*b*8 may deviate from a desired light path. However, according to the illumination device of the exemplary embodiment, this deviation of the light path can be prevented.

In the illumination device of the exemplary embodiment, the eight radiation fins 2*b*1-2*b*8 are provided in the lens holder 2. Alternatively, any number (other than eight) of the radiation fins may be provided in the lens holder.

Furthermore, in the illumination device of the exemplary embodiment, each of the reflection surfaces 2*b*1*a* and 2*b*1*b*-2*b*8*a* and 2*b*8*b* of the radiation fins 2*b*1, -2*b*8 and the reflection surfaces 2*a*1-2*a*8 and 2*c*1-2*c*8 of the corresponding bridging portions 2*a* and 2*c* is a planar surface. Alternatively, each of these reflection surfaces may be any surface such as the surface of a parabolic cylinder. In addition, any of the above disclosed reflection surfaces can be formed by depositing or otherwise applying a reflective paint or material onto a respective portion of the device. In addition, the reflection surface could be formed by angling the respective portion of the device with respect to the angle of incidence of the light, such that the light cannot penetrate the portion of the device and is reflected thereby—in which case the portion of the device can be made of a partially or totally light transmissive material.

Furthermore, in the illumination device of the exemplary embodiment, the lens 1 is provided for guiding the light from the light emitting element 4. Alternatively, in an illumination device according to another embodiment, the lens 1 may be omitted.

Furthermore, the configurations of the above-described embodiments may appropriately be combined with each other.

The illumination device of the disclosed subject matter is especially applicable to, for example, a vehicle lamp, a general illumination lamp, a lamp for toys, etc. However, numerous additional applications exist for the disclosed technology.

While there has been described what are at present considered to be exemplary embodiments of the invention, it will be understood that various modifications may be made thereto, and it is intended that the appended claims cover such modifications as fall within the true spirit and scope of the invention.

What is claimed is:

1. An illumination device, comprising:

a light emitting element;

a plurality of radiation fins located adjacent the light emitting element and configured to dissipate heat generated by the light emitting element, the radiation fins being radially disposed about the light emitting element, wherein an aperture is located between adjacent ones of the radiation fins and is configured to allow light from the light emitting element to pass therethrough, and the radiation fins include a reflection surface configured to reflect light which is incident thereon, the plurality of radiation fins are disposed radially outside of the light emitting element; and a first bridge structure configured to bridge the plurality of radiation fins, the first bridge structure including a reflection surface configured to reflect light which is incident thereon, the first bridge structure reflecting surface configured to face the plurality of radiation fins.

2. The illumination device according to claim 1, wherein the first bridge structure and the plurality of radiation fins are integrally formed as a single component.

3. The illumination device according to claim 1, wherein the first bridge structure is an annular structure.

4. The illumination device according to claim 1, wherein the illumination device includes an optical axis along which the light emitting element emits light, and the plurality of radiation fins and the light emitting element are located at substantially the same position along the optical axis.

5. The illumination device according to claim 1, wherein the illumination device includes an optical axis along which the light emitting element emits light in a light emitting direction, and the plurality of radiation fins extend from a position adjacent the light emitting element to a position spaced from the light emitting element and in the light emitting direction along the optical axis of the illumination device.

6. The illumination device according to claim 1, wherein the light emitting element is a light emitting diode.

7. The illumination device according to claim 1, further comprising:

a lens configured to guide the light from the light emitting element, the lens being press-fitted inside an inner peripheral surface of one of the first and second bridge structures.

8. The illumination device according to claim 7, wherein the first bridge structure and the plurality of radiation fins are integrally formed as a single component.

9. The illumination device according to claim 1, further comprising:

a second bridge structure, wherein the first and second bridge structures are disposed at central axial ends of the plurality of radiation fins, respectively.

10. The illumination device according to claim 9, wherein the first bridge structure and the plurality of radiation fins are integrally formed as a single component.

11. The illumination device according to claim 9, wherein the first and second bridge structures and the plurality of radiation fins are integrally formed as a single component.

12. The illumination device according to claim 9, further comprising:

a lens configured to guide the light from the light emitting element, the lens being press-fitted inside an inner peripheral surface of one of the first and second bridge structures.

13. The illumination device according to claim 12, wherein the first bridge structure and the plurality of radiation fins are integrally formed as a single component.

* * * * *